US005083546A

United States Patent [19]

Detweiler et al.

[11] Patent Number: 5,083,546

[45] Date of Patent: Jan. 28, 1992

[54] TWO-STAGE HIGH FLOW PURGE VALVE

[75] Inventors: Charles A. Detweiler, Durand; Richard A. Schultz, Troy; Peter J. Henning, Waterford, all of Mich.

[73] Assignee: Lectron Products, Inc., Rochester Hills, Mich.

[21] Appl. No.: 656,510

[22] Filed: Feb. 19, 1991

[51] Int. Cl.[5] ..... F02M 33/02

[52] U.S. Cl. ..... 123/520; 123/516; 137/599; 137/907

[58] Field of Search ..... 123/516, 518, 519, 520, 123/521, 458, 463; 137/599, 599.1, 630.16, 907, 614.21; 251/129.05, 129.15

[56] References Cited

U.S. PATENT DOCUMENTS

| | | | |
|---|---|---|---|
| 3,414,336 | 12/1968 | Atkin et al. | 137/599 |
| 3,476,146 | 11/1969 | Dolter | 137/599 |
| 4,019,533 | 4/1977 | Jerde et al. | 137/599 |
| 4,112,898 | 9/1978 | Takimoto et al. | 123/521 |
| 4,377,146 | 3/1983 | Oniki et al. | 137/907 |
| 4,503,887 | 3/1985 | Johnson et al. | 137/599 |
| 4,628,887 | 12/1986 | Mitchell et al. | 137/907 |
| 4,681,297 | 7/1987 | Mertz | 137/599 |
| 4,700,683 | 10/1987 | Uranishi et al. | 123/519 |
| 4,703,737 | 11/1987 | Cook et al. | 123/518 |
| 4,805,666 | 2/1989 | Araki et al. | 137/599.1 |
| 4,809,667 | 3/1989 | Uranishi et al. | 123/518 |
| 4,875,499 | 10/1989 | Fox | 137/907 |
| 4,901,702 | 2/1990 | Beicht et al. | 123/520 |
| 4,932,386 | 6/1990 | Vozumi et al. | 123/521 |
| 4,944,276 | 7/1990 | House et al. | 123/520 |
| 4,947,887 | 8/1990 | Fox | 137/907 |
| 4,951,637 | 8/1990 | Cook | 123/519 |
| 4,961,412 | 10/1990 | Furuyama | 123/520 |
| 4,995,369 | 2/1991 | Cook | 123/520 |

FOREIGN PATENT DOCUMENTS

| | | | |
|---|---|---|---|
| 2125002 | 4/1972 | Fed. Rep. of Germany | 137/599 |
| 0134088 | 8/1982 | Japan | 137/599 |

*Primary Examiner*—E. Rollins Cross
*Assistant Examiner*—Tom Moulis
*Attorney, Agent, or Firm*—Harness, Dickey & Pierce

[57] ABSTRACT

A two-stage high flow purge valve for an evaporative emission system of a vehicle. The valve body contains two valves for controlling fluid flow through separate parallel flow paths in the valve body. A fast-acting, pulse width modulated solenoid valve responsive to an electrical control signal from the engine control computer precisely controls flow through a low flow path, and a vacuum-responsive valve controls flow through a high flow path in accordance with the level of manifold vacuum at the engine intake. A third valve member is provided to block flow through the high flow path when the engine is off and the manifold vacuum is zero. Means for calibrating both the solenoid valve and the vacuum-responsive valves are also provided.

28 Claims, 6 Drawing Sheets

TWO-STAGE HIGH FLOW PURGE VALVE

BACKGROUND AND SUMMARY OF THE INVENTION

The present invention relates to evaporative emission control systems for vehicles and in particular to a purge valve that is adapted to be controlled by the engine management control system for regulating the supply of fuel vapors to the engine intake from the fuel tank vapor recovery system.

In order to meet current emission requirements, present day vehicles contain evaporative emission control systems which reduce the quantity of gasoline vapors emanating from the fuel tank of the vehicle. Generally, these systems include a charcoal canister which traps the vapors from the fuel tank, and a purge system which draws the vapors out of the canister and feeds them into the intake system of the engine when the engine is running. The fuel vapors are drawn into the engine intake manifold along with atmospheric air drawn through the canister.

The capability of the canister to trap vapors from the fuel tank is greatly dependent upon how thoroughly the vapors are purged from the canister when the vehicle was last operated. Accordingly, it is desirable to purge the canister as much as possible while the engine is running. However, the amount of vapor that can be drawn into the engine at any time is limited by the total airflow into the engine and the accuracy with which the purge flow can be controlled. At high speeds or under high engine loads, high purge flow rates can be easily handled. Under such conditions, however, the manifold vacuum is low which tends to limit the amount of fuel vapors and air which can be drawn from the canister into the engine intake manifold. In addition, when the engine is at idle, the airflow into the engine is low. Therefore, purgining at idle must be precisely controlled to prevent a rough idle. Moreover, due to the varying ratio of air to fuel vapors in the purge system, purging during idle can significantly impact the resulting air/flow ratio of the fuel mixture supplied to the engine. Consequently, purging at idle can easily result in a too rich or too lean fuel mixture causing excessive tailpipe emissions unless purging at idle is limited to low flow rates. Current emissions systems, therefore, do not generally purge the canister at idle to any substantial degree.

However, impending tighter emissions requirements and changes to the EPA testing procedures will require larger capacity canisters and therefore higher capacity purge systems. Moreover, the prospect of on-board refueling vapor recovery systems will only add to these system requirements. Accordingly, it is becoming imperative that such systems not only purge at idle, but that maximum flow rates be increased as well. This, of course, presents conflicting requirements for purge systems. Specifically, in order to purge at idle, the purge flow rate must be fairly low and accurately controlled by the engine control computer which monitors the resulting oxygen content of the exhaust gases from the engine. When a canister is saturated with fuel, and vapor is initially purged, the purge flow is very high in fuel vapor. After most of the fuel vapors are drawn out of the charcoal, the purge flow is almost pure air. Therefore, the purge control valve must be capable of allowing the engine control computer to precesely control small flow rates at idle while correcting the idle fuel-air ratio so that tailpipe emissions are not adversely affected. This type of precise flow control is best accomplished using a relatively small valve.

On the other hand, it is desirable to purge at very high flow rates when the engine is operating under high speed or heavy load conditions when it can efficiently consume significant quantities of fuel vapor and air with a minimum effect on fuel air ratios. In order to achieve large flow rates, it is necessary for the purge valve to provide a relatively large flow passage. This requirement, of course, is in direct conflict with the requirement for precise low flow rate control. Specifically, it is believed to be impractical to provide a valve large enough to satisfy the high flow requirements which at the same time is capable of precisely modulating the opening of the valve to meet the low flow requirements.

Accordingly, it is the primary object of the present invention to provide a two-stage purge control valve that is capable of providing both precise control at low flow rates and high flow capacity at low manifold vacuum pressures. In general, this is accomplished by providing a single assembly having two valves which control separate parallel flow paths. Low flow control is achieved with a small solenoid valve adapted to be driven by a pulse width modulated (PWM) signal from the engine control computer. High flow capacity is provided by a vacuum-controlled valve which opens at low manifold vacuum pressures. Because purge flow comprises a relatively small percentage of total air flow into the engine under the conditions when the high flow stage is open, precise control of the high flow capacity valve by the engine control computer is not required.

Accordingly, the purge valve according to the present invention allows the full range from 10% to 90% duty cycle control to be used to control low flow rates and opens the high flow valve only when the purge flow comprises a small portion of the total engine intake air flow. Moreover, the high flow valve is adapted to open gradually as engine manifold vacuum pressure decreases, thereby proportioning the purge flow to the total engine intake air flow. In addition, the engine control computer can still adjust the high purge flow rate to a degree by controlling the parallel flow through the PWM solenoid valve.

In the preferred embodiment of the present invention, the response and flow capacity of both the low and high flow control valves can be calibrated to meet the requirements of a particular engine family or purge system. Additional objects and advantages of the present invention will become apparent from a reading of the following description of the preferred embodiments which make reference to the drawings of which:

DETAILED DESCRIPTION OF THE PREFERRED EMBODIMENTS

Figure 1:
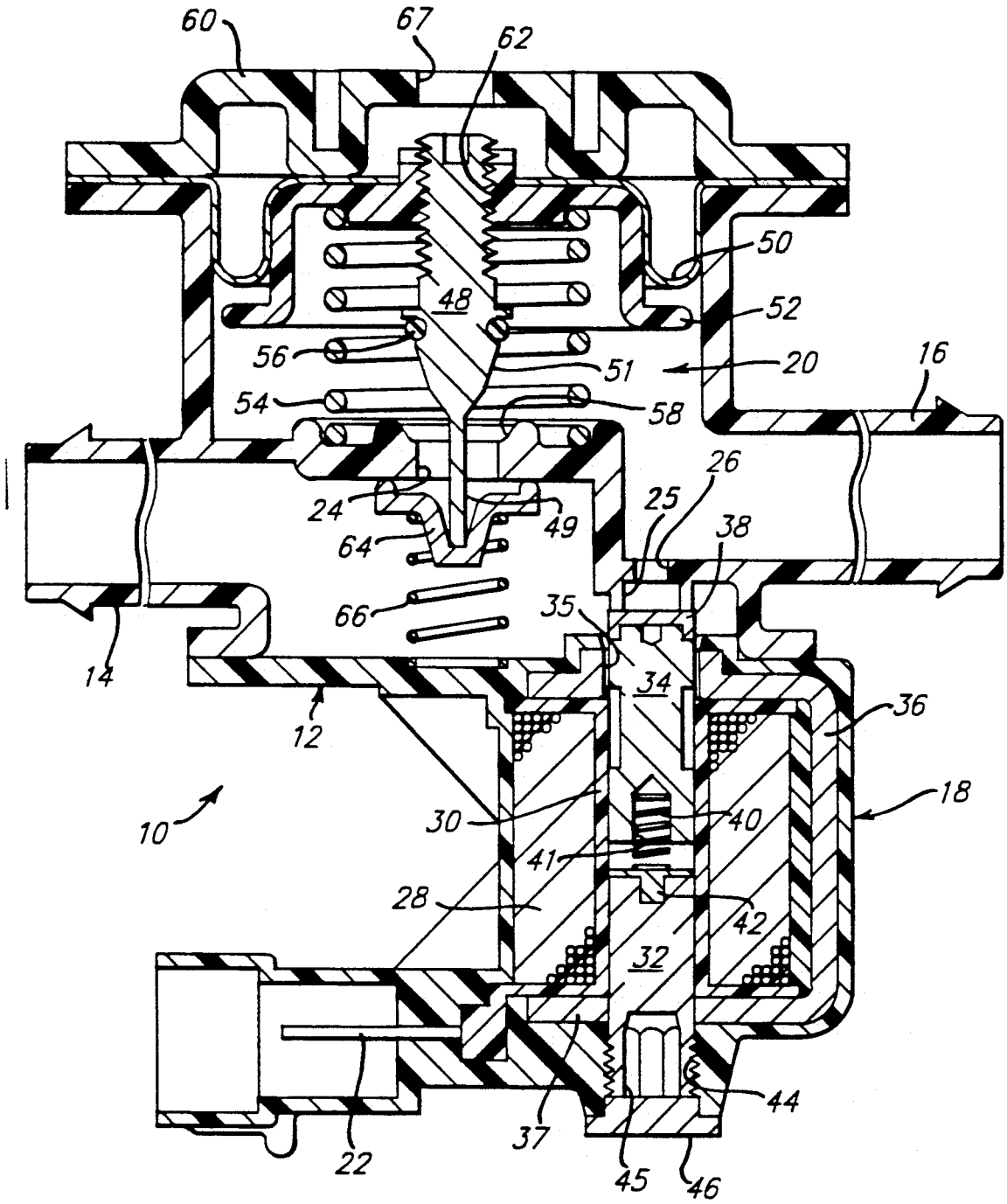
FIG. 1 is a sectional view of a two-stage purge valve according to the present invention with the valves in the closed position corresponding to the engine being off.

Referring to FIG. 1, a sectional view of a two-stage high flow purge valve 10 according to the present invention is shown. The purge valve 10 is adapted to be connected between the intake system of the engine of the vehicle and the charcoal canister which traps fuel vapors from the fuel tank of the vehicle. The purge valve 10 is responsive to engine manifold vacuum pressures and is also adapted to be controlled by the engine control computer to regulate the rate at which fuel vapors are drawn from the charcoal canister into the engine intake manifold.

The purge valve 10 comprises a valve body 12 having an inlet port 14 adapted for connection to the charcoal canister and an outlet port 16 adapted for connection to the engine intake manifold. Hence, a negative pressure or vacuum is present at outlet port 16 when the vehicle engine is operating which serves to draw fuel vapors from the charcoal canister as permitted by the purge valve 10.

The purge valve 10 controls the flow of vapors from the canister to the engine intake via two valve structures which control separate parallel flow paths through the valve body 12. In particular, the present two-stage purge valve 10 includes a small solenoid valve 18 for providing precise low flow control and a vacuum-controlled valve 20 for providing high flow capacity. The solenoid valve 18 controls purge flow from the inlet port 14 to the outlet port 16 through a first low flow orifice 26 in the valve body 12. The vacuum-controlled valve 20 controls purge flow from the inlet port 14 to the outlet port 16 through a second high flow orifice 24 in the valve body 12.

The solenoid valve 18 comprises a solenoid coil 28 that is wrapped around a bobbin 30 having a central bore containing a pole piece 32 and a movable armature 34. The ends of the coil windings 28 of the solenoid 18 are terminated at an electrical connector 22 that is adapted for electrical connection to the engine control computer of the vehicle. The return flux path for the solenoid is provided by a C-frame member 30 that is secured to the pole piece at one end 37 and has an opening 35 formed in its other end through which the armature 34 extends to thereby permit axial movement of the armature 34. The armature 34 has attached to its exposed end an elastic member 38 which is adapted to seal valve seat 25 which controls the flow through low flow orifice 26 in the valve body 12. A small compression spring 40 is disposed within a bore 41 formed in the opposite end of the armature 34 between the pole piece 32 and the armature 34 to bias the armature 34 into the normally closed position illustrated in FIG. 1. A pad 42 is provided on the end of the pole piece 32 opposite the armature 34 to absorb the impact of the armature 34 and quiet the sound of the solenoid when the armature is attracted to the pole piece 32 when the solenoid 18 is energized.

The solenoid valve 18 is adapted to operate in response to a pulse width modulated (PWM) signal received from the engine control computer. In particular, the duty cycle of the PWM signal received from the engine control computer will determine the rate of purge flow through orifice 26 in the valve body 12. Due to the relatively short stroke of the armature 34 of the solenoid valve 18, the rate of purge flow possible through orifice 26 in valve body 12 is relatively limited. On the other hand, the rapid response characteristics of the solenoid valve 18 permit the engine control computer to precisely regulate the purge flow through orifice 26.

The high flow vacuum responsive valve 20 comprises a poppet valve 48 that includes a tapered pintle portion 49 that extends into the orifice 24 in the valve body. The pintle 49 thus ensures that the poppet valve 48 remains in proper alignment with the orifice 24. The position of the poppet valve 48 is controlled by a diaphragm 50 via a diaphragm guide member 52 that is attached to the diaphragm 50 and threadedly connected to the poppet valve 48. The diaphragm 50 is secured about its periphery to the valve body 12 via a cover 60 that is fastened to the valve body. A compression spring 54 is disposed between the valve body 12 and the diaphragm guide member 52 to bias the poppet valve 48 into its normally open position. An O-ring 56 is provided on the poppet valve and is adapted to seal against the tapered seat 58 of the orifice 24 in the valve body.

Figure 2:
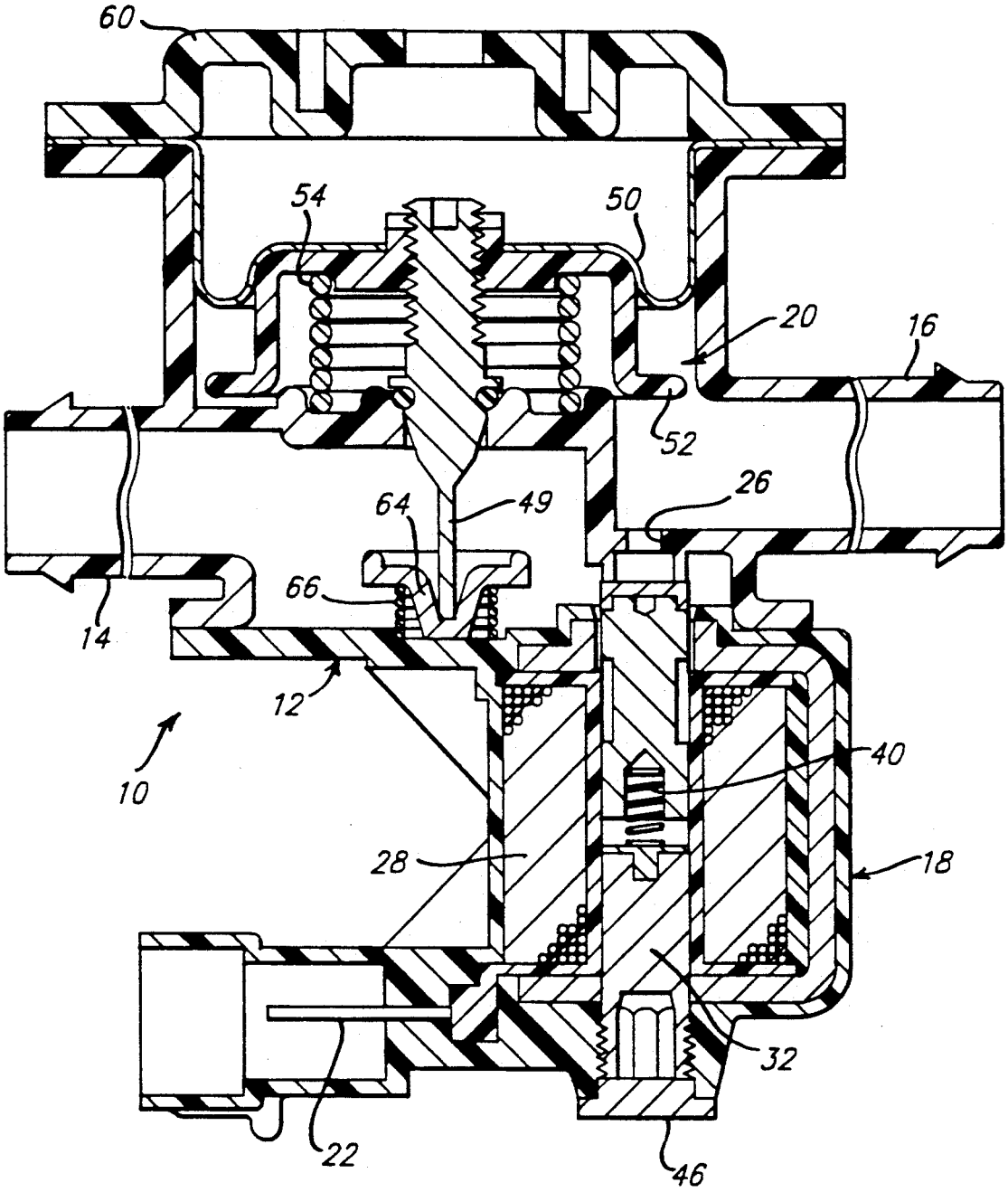
FIG. 2 is a sectional view of the two-stage purge valve shown in FIG. 1 with the valves in the closed position corresponding to high engine manifold vacuum.
Figure 3:
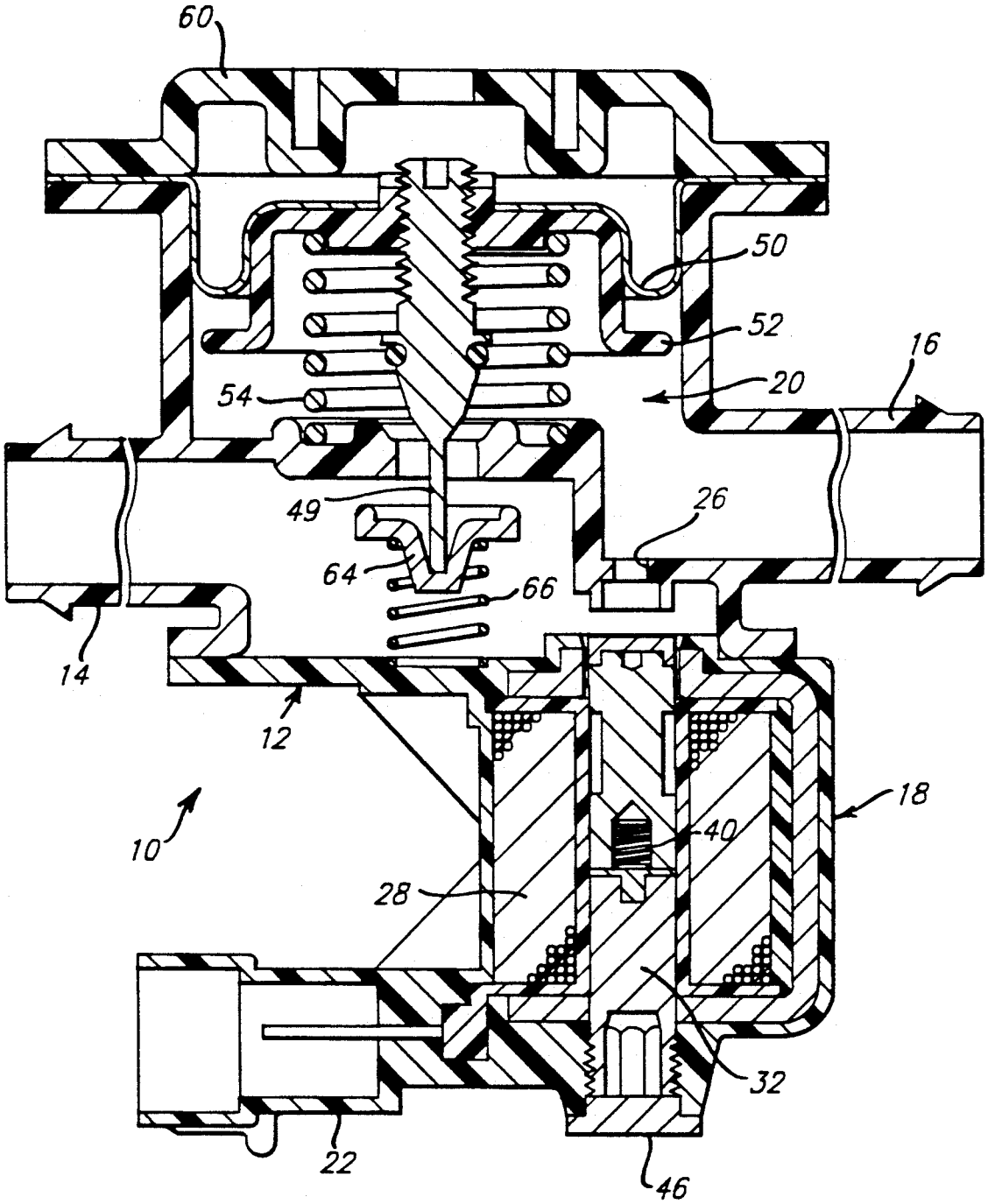
FIG. 3 is a sectional view of the two-stage purge valve shown in FIG. 1 with the valves in the maximum flow position corresponding to low engine manifold vacuum.

In operation, when the vehicle engine is idling, a high degree of vacuum pressure is present at outlet port 16, thereby drawing diaphragm 50 downwardly causing O-ring 56 to seal against seat 58 and closing the high flow valve 20, as shown in FIG. 2. As previously noted, as engine speed or engine loading increases, the amount of vacuum pressure decreases. As engine speed increases off idle, therefore, a point is reached whereby the vacuum pressure at outlet port 16 is no longer sufficient to hold the poppet valve 48 in the closed position against the force of compression spring 54 and poppet valve 48 begins to open. In the preferred embodiment, this point corresponds to a vacuum pressure of approximately ten inches of mercury. As vacuum pressure decreases further, the poppet valve 48 continues to open thereby permitting increased purge flow through orifice 24 in valve body 12. Under high engine load conditions when manifold vacuum is lowest (e.g., 2–3 inches of mercury), the vacuum pressure at outlet port 16 can only compress spring 54 slightly as shown in FIG. 3, thereby maximizing the purge flow through orifice 24. To summarize, therefore, at or near engine idle when vacuum pressure is highest, poppet valve 48 is in the closed position shown in FIG. 2, and at high engine loads when vacuum pressure is lowest, poppet valve 48 is in the fully open position shown in FIG. 3.

Preferably, the pintle portion 49 of poppet valve 48 is provided with a tapered shoulder portion 51 so that the purge flow through orifice 24 increases gradually with decreasing vacuum pressure. In this manner, a degree of proportional control of purge flow through the high flow valve 20 is provided relative to the amount of vacuum pressure. However, it will be appreciated that other relationships between vacuum pressure and purge flow can be achieved by altering the configuration of the pintle 49.

In addition, the preferred embodiment includes an additional valve element comprising a valve disc 64 which is positioned on the pintle end 49 of the poppet valve 48 by a compression spring 66. Valve element 64 is effective to close the purge flow passage through orifice 24 when the engine is turned off and the vacuum pressure at outlet port 16 is zero. The purpose of this additional valve 64 is to prevent the escape of fuel vapors from the canister through the purge valve 10, intake manifold, and air cleaner to atmosphere when the engine of the vehicle is turned off. To ensure that this additional valve 64 does not otherwise adversely affect the purge flow, the valve 64 is designed to open when the manifold vacuum pressure is at any level greater than approximately one inch of mercury. Accordingly, this allows full flow through the purge system at manifold vacuums of two to three inches of mercury.

In order to permit the solenoid valve 18 to be accurately calibrated so as to provide a predetermined purge flow for a given duty cycle control signal, the end of the pole piece 32 opposite the armature 34 is threaded at 44 to the valve body 12 to permit axial adjustment of the position of the pole piece 32 which in turn determines the stroke of the armature 34 and hence the degree to which passageway 26 is opened. Once the solenoid valve 18 is calibrated, the access opening to the pole piece is covered by a cap lock 46.

In addition, means are also preferably provided for calibrating the high flow vacuum-controlled valve 20 as well. In particular, the poppet valve 48 is, as noted, threaded to the diaphragm guide member 52 thereby permitting the axial position of the poppet valve 48 to be adjusted relative to the diaphragm 50 and guide member 52. Consequently, the degree to which the poppet valve 48 is opened, and hence the amount of purge flow through the high flow passage 24, can be calibrated to a given vacuum pressure level. Access for calibrating the position of the poppet valve 48 is provided through an opening 67 in the valve cover 60 which is then covered by a plug (now shown) when the calibration process is completed.

Figure 4:
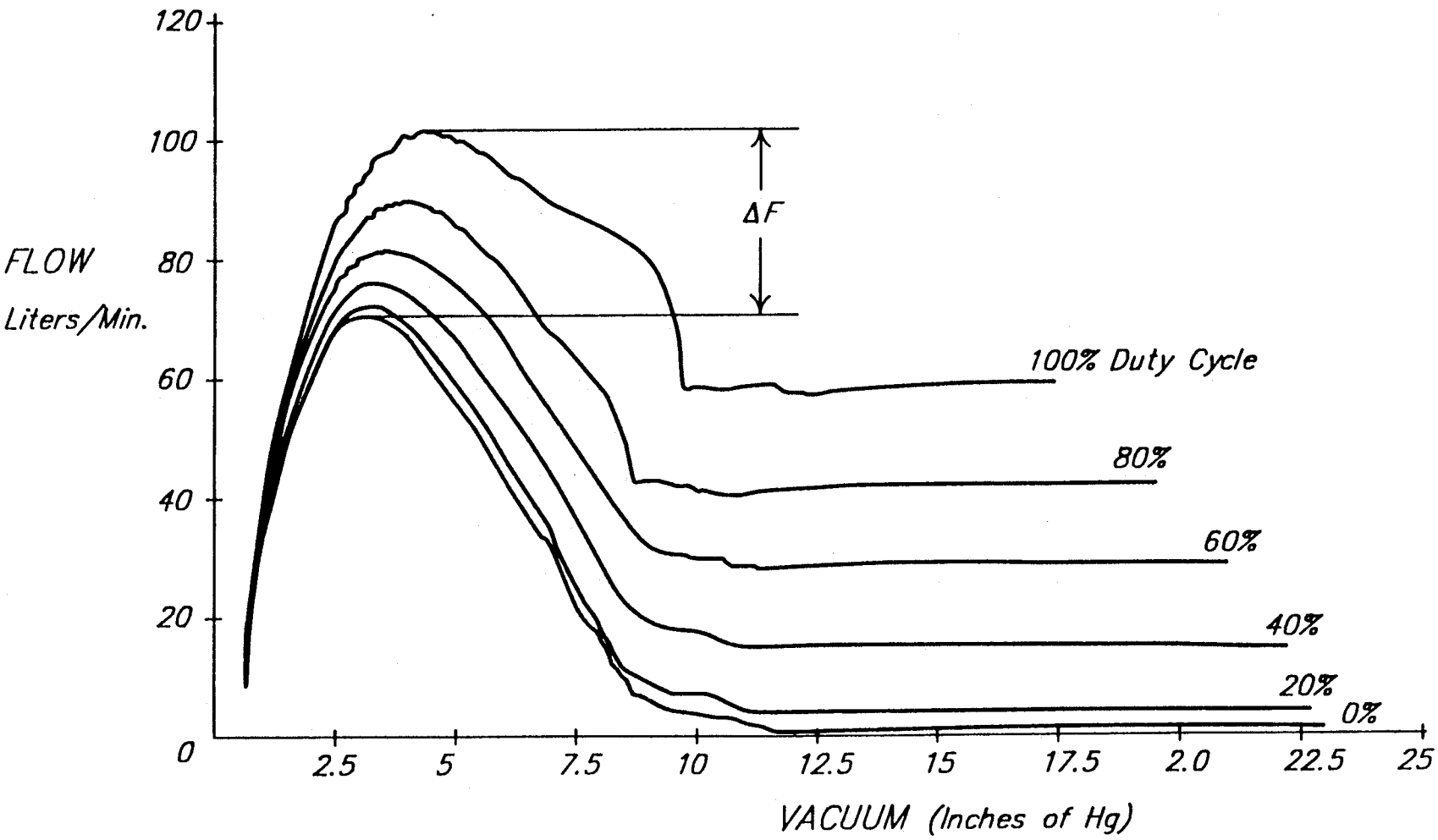
FIG. 4 is a graph of the flow versus vacuum pressure characteristics of the purge valve shown in FIG. 1.

Turning now to FIG. 4, a series of exemplary flow versus vacuum pressure curves at various duty cycles for the preferred embodiment of the present two-stage purge valve 10 is shown. The curves shown in FIG. 4 represent the total combined purge flow through both valves 18 and 20 in the valve body 12. From a review of the flow curves, the operational characteristics of the present purge valve 10 are readily apparent. Firstly, it can be seen that at vacuum pressures above approximately ten inches of mercury, the high flow vacuum-controlled valve 20 is closed and purge flow through the valve body 12 is controlled exclusively by the PWM solenoid valve 18. Secondly, it can be seen that even under high flow, low vacuum conditions when the vacuum-controlled valve 20 is fully opened, the engine control computer retains a substantial range of control over total purge flow via control of the PWM solenoid valve 18. This minimum control range available to the engine control computer is designated "ΔF" in the diagram. Thirdly, the curves clearly demonstrate a substantially linear relationship between vacuum pressure and purge flow below approximately eight inches of mercury where the tapered shoulder portion 51 of the pintle 49 controls the size of the opening through valve orifice 24. Accordingly, it can be seen that the vacuum-controlled valve 20 varies purge flow progressively with changes in vacuum pressure. However, as previously noted, other relationships can be achieved in this region by varying the shape of the pintle 49.

Figure 5:
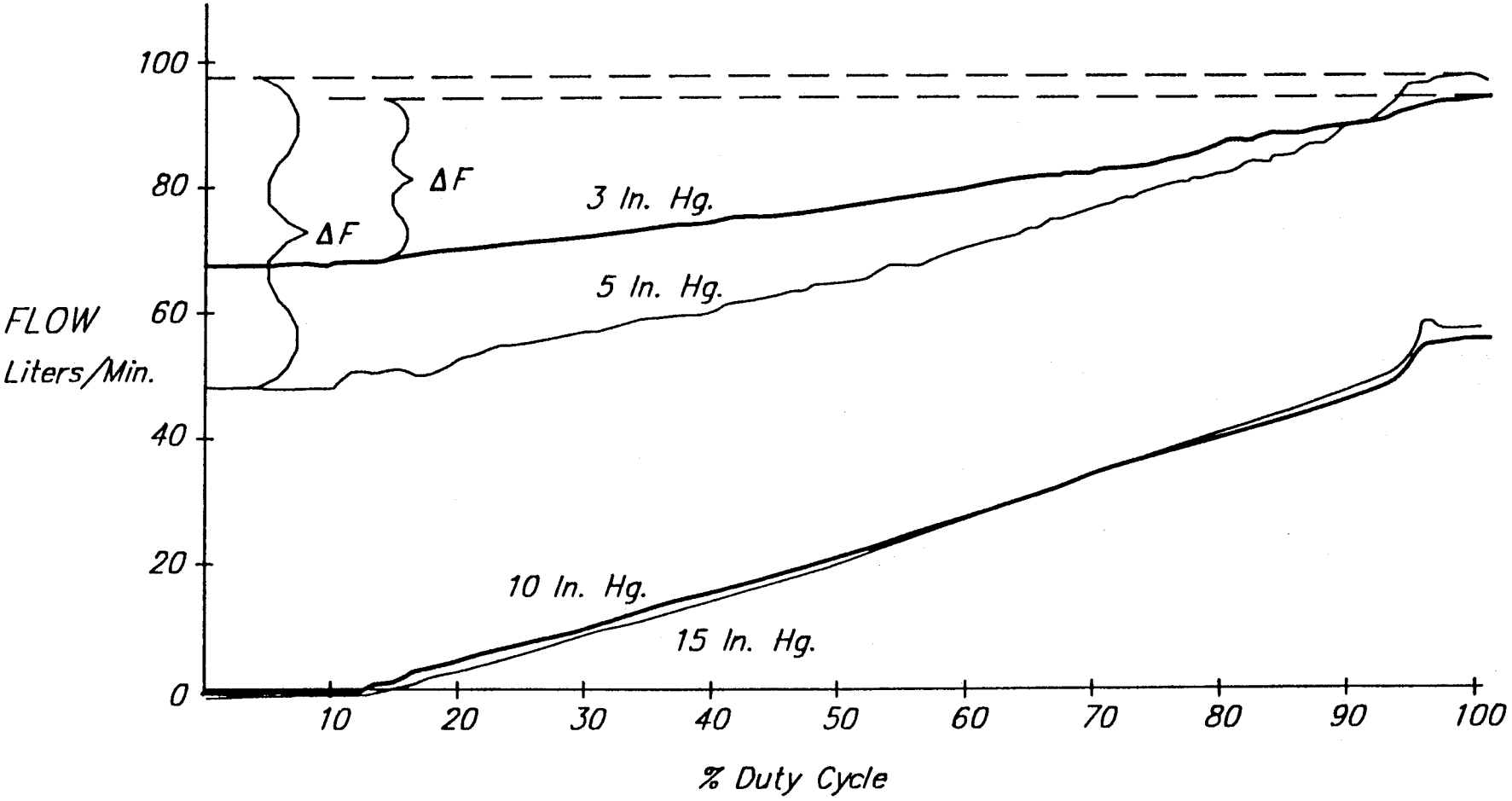
FIG. 5 is a graph of the flow versus percentage duty cycle characteristics of the two-stage purge valve shown in FIG. 1.

With additional reference to FIG. 5, a series of curves illustrating the relationship between total purge flow and percentage duty cycle at various vacuum pressure levels is shown. These curves also clearly demonstrate that above vacuum pressures of approximately ten inches of mercury, total flow through the valve body 12 is governed exclusively by the PWM solenoid valve 18. In addition, the two upper curves illustrate the range of flow control ("ΔF") available to the engine control computer via control of the PWM solenoid valve 18 at vacuum pressures of three inches and five inches of mercury when substantial purge flow exists through the vacuum-controlled valve 20.

Figure 6:
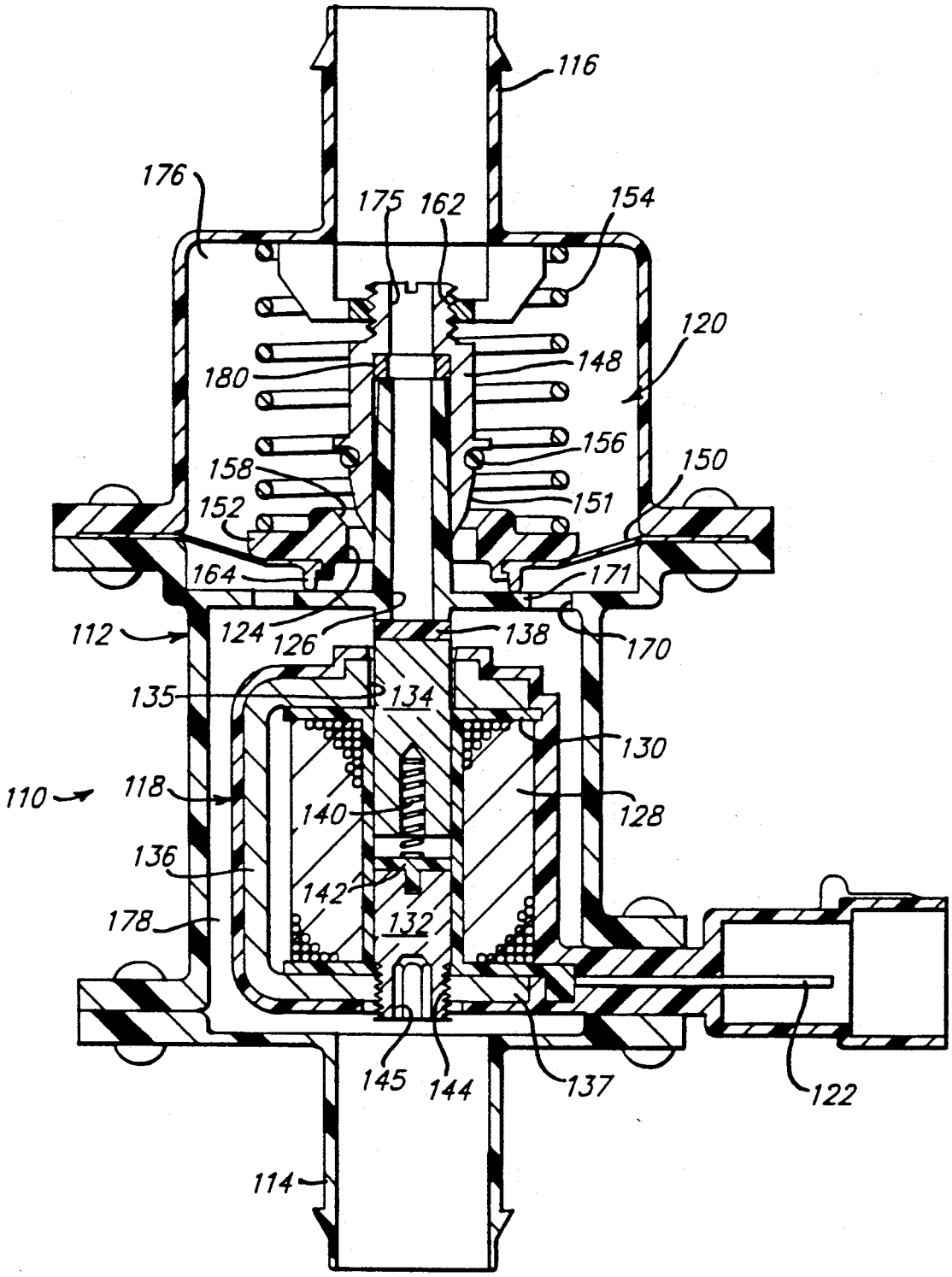
FIG. 6 is a sectional view of an alternative embodiment of the two-stage purge valve according to the present invention.

Referring to FIG. 6, an alternative embodiment of the two-stage high flow purge valve 110 according to the present invention is shown. In this embodiment, the diaphragm-controlled valve 120 and the solenoid valve 118 are located along the same axis. Components in the embodiment illustrated in FIG. 6 that are functionally equivalent to the components described in the embodiment illustrated in FIGS. 1-3 are similarly numbered such that, for example, inlet port 14 and outlet port 16 in FIGS. 1-3 correspond to inlet port 114 and outlet port 116, respectively, in FIG. 6. The valve body 112 and cover 160 in the embodiment illustrated in FIG. 6 define an upper chamber 176 which communicates with outlet port 116 and a lower chamber 178 which communicates with inlet port 114. An annular-shaped passageway 170 is formed in the valve body to provide communication between the upper chamber 176 and the lower chamber 178. The valve body 112 in this embodiment includes an integrally formed central stem portion 172 that extends upwardly into the upper chamber 176 and has formed therethrough a bore 126 which comprises the low flow orifice passageway.

In addition, it will be noted that the high flow, vacuum-controlled valve 120 has been modified to provide a fixed valve member 148 and a movable orifice 124. In particular, the valve member 148 in this embodiment has a central bore 175 formed therein that is adapted to communicate with the bore 126 and the stem portion 172 of the valve body 112. In addition, the valve member 148 has an enlarged counterbore 174 that enables the valve member 148 to be mounted onto the stem 172. A seal 180 is provided at the base of the counterbore 174 to prevent air leakage between the valve member 148 and the stem 172 of the valve body. The stationary valve member 178 is adapted to cooperate with the movable orifice 124 formed in the diaphragm support member 152 attached to the diaphragm 150. Accordingly, when a high manifold vacuum pressure is present at outlet port 116, the support member 152 is moved upwardly by the diaphragm 150 against the bias of compression spring 154 until the O-ring 156 on the valve member 148 seals against the chamfered seat 158 surrounding orifice 124.

It will also be noted that the diaphragm 150 in this embodiment includes an annular-shaped raised rib 164 that is adapted to seal against the wall 171 of the valve body 112 separating the upper chamber 176 from the lower chamber 178 to thereby close the high flow valve 120 when the engine is off and the manifold vacuum pressure is zero. In other words, the annular-shaped rib 164 on the diaphragm serves the equivalent function of the valve member 64 in the embodiment illustrated in FIGS. 1-3.

Furthermore, by locating the solenoid valve 118 in the lower chamber 178 of the valve body 112 and hence within the purge flow path, a means of cooling the solenoid coil 118 is provided. Optionally, the inlet and outlet ports 114 and 116 may be located on the sides of the valve housing 112 if packaging requirements of a particular application dictate such a configuration.

While the above description constitutes the preferred embodiments of the invention, it will be appreciated that the invention is susceptible to modification, variation, and change without departing from the proper scope or fair meaning of the accompanying claims.

What is claimed is:

1. A two-stage valve for a vehicle having an internal combustion engine comprising:

a valve body defining an inlet port adapted for connection to a source of fluid and an outlet port adapted for connection to a source of vacuum;

a high flow orifice defining a first flow path through said valve body from said inlet port to said outlet port;

a low flow orifice defining a second flow path through said valve body from said inlet port to said outlet port in parallel with said first flow path;

first valve means responsive to the level of vacuum pressure at said outlet port for controlling the fluid flow through said high flow orifice; and second valve means comprising a solenoid valve for controlling the fluid flow through said low flow orifice in response to an electrical signal supplied to said solenoid valve.

2. The two-stage valve of claim 1 wherein said first valve means is adapted to close said high flow orifice at vacuum pressures above a predetermined level and to open said high flow orifice at vacuum pressures below said predetermined level.

3. The two-stage valve of claim 2 wherein said first valve means is adapted to progressively open said high flow orifice as vacuum pressure decreases below said predetermined level such that the fluid flow rate through said high flow orifice varies proportionally with changes in vacuum pressure.

4. The two-stage valve of claim 2 further including third valve means for blocking said first flow path when the engine is not running.

5. The two-stage valve of claim 4 wherein said third valve means is operatively associated with said first valve means for blocking said first flow path when the vacuum pressure at said outlet port is substantially equal to zero.

6. The two-stage valve of claim 1 wherein said solenoid valve comprises a fast-acting, on/off solenoid valve that is adapted to be controlled by a pulse width modulated electrical signal for precisely controlling the fluid flow through said low flow orifice.

7. The two-stage valve of claim 5 wherein said first valve means includes a valve member having a pintle portion that extends into said high flow orifice for controlling the size of said high flow orifice.

8. The two-stage valve of claim 7 wherein said third valve means is actuated by said pintle portion of said valve member.

9. The two-stage valve of claim 7 wherein said first valve means further includes a diaphragm connected to said valve member and a bias member acting on said diaphragm against the force of vacuum pressure at said outlet port for actuating said valve member to vary the size of said high flow orifice in accordance with the vacuum pressure at said outlet port.

10. The two-stage valve of claim 9 wherein said pintle portion has a tapered shoulder portion for progressively varying the size of said high flow orifice as said valve member is actuated.

11. In a vehicle evaporative emission control system including a charcoal canister for trapping fuel vapors emanating from the fuel tank of the vehicle and a purge system for drawing the fuel vapors out of the canister and feeding them into the intake system of the engine of the vehicle while the engine is running, the engine having an engine control computer for controlling the fuel/air mixture fed into the engine, a two-stage purge valve adapted for connection into the purge system for controlling the purge flow from the charcoal canister to the engine intake system, comprising:

a valve body having an inlet port adapted for connection to the charcoal canister and an outlet port adapted for connection to the intake system of the engine;

a high flow orifice defining a first flow path through said valve body from said inlet port to said outlet port;

a low flow orifice defining a second flow path through said valve body from said inlet port to said outlet port in parallel with said first flow path;

vacuum responsive valve means for controlling the flow through said high flow orifice, including a valve member for controlling the effective size of said high flow orifice and having a first position wherein said high flow orifice is closed and a second position wherein said high flow orifice is fully opened, bias means for biasing said valve member toward said second position, and a diaphragm connected to said valve member and responsive to the vacuum pressure at said outlet port for controlling the position of said valve member, such that at vacuum pressures above a predetermined level said valve member is in said first position and at vacuum pressures below said predetermined level said high flow orifice is opened; and solenoid valve means for controlling the flow through said low flow orifice including a solenoid having a coil adapted for electrical connection to the engine control computer and a valve member responsive to the energization of said solenoid coil by an electrical signal from the engine control computer for controlling the flow through said low flow orifice.

12. The system of claim 11 wherein said vacuum responsive valve means is adapted to progressively increase purge flow through said high flow orifice as vacuum pressure decreases below said predetermined level such that the purge flow rate through said high flow orifice varies proportionally with changes in vacuum pressure.

13. The system of claim 11 wherein said purge valve further includes third valve means for closing said first flow path when the engine is not running.

14. The system of claim 11 wherein said purge valve further includes a zero vacuum valve operatively associated with said vacuum responsive valve means for blocking said first flow path when said valve member is in said second position.

15. The system of claim 14 wherein said valve member includes a pintle portion that extends into said high flow orifice for controlling the size of said high flow orifice and said zero vacuum valve is actuated by said pintle portion of said valve member.

16. The system of claim 14 wherein said zero vacuum valve comprises an annular-shaped seal formed on said diaphragm.

17. The system of claim 12 wherein said vacuum responsive valve means further includes means for calibrating the size of said high flow orifice at a predefined vacuum pressure level.

18. The system of claim 12 wherein said solenoid includes a pole piece and an armature defining an air gap therebetween and means for calibrating the response of said solenoid by varying the size of said air gap.

19. A two-stage valve for a vehicle having an internal combustion engine comprising:

a valve body having a central axis, an inlet port adapted for connection to a source of fluid and an outlet port and adapted for connection to a source of vacuum and defining a first chamber in fluid communication with said inlet port and a second chamber in fluid communication with said outlet port, said first and second chambers being separated by a wall in said valve body;

a low flow orifice concentric with said central axis and defining a first flow path through said wall from said first chamber to said second chamber;

a high flow orifice concentric with said central axis and defining a second flow path through said wall from said first chamber to said second chamber in parallel with said first flow path;

a solenoid valve having an axis aligned with said central axis for controlling the flow through said low flow orifice in accordance with an electrical signal supplied to said solenoid valve; and vacuum responsive valve means having an axis aligned with said central axis for controlling the flow through said high flow orifice in accordance with the level of vacuum pressure in said second chamber.

20. The two-stage valve of claim 19 wherein said solenoid valve is mounted to said valve body within said first chamber so as to be within said first and second flow paths.

21. The two-stage valve of claim 19 wherein said vacuum responsive valve means is located within said second chamber and includes a valve member defining said high flow orifice, a fixed pintle member mounted to said valve body, a diaphragm connected to said valve member for actuating said valve member relative to said fixed pintle member such that at low vacuum pressure levels said high flow orifice is open and at high vacuum pressure levels said high flow orifice is closed, and a spring for biasing said valve member toward said open position.

22. The two-stage valve of claim 21 wherein said valve body further includes a stem portion aligned with said central axis and integral with said wall and having a bore defining said low flow orifice, said fixed pintle member being mounted to said stem portion.

23. The two-stage valve of claim 21 further including a zero vacuum valve for blocking fluid flow through said second flow path when the engine is not running.

24. The two-stage valve of claim 23 wherein said zero vacuum valve blocks fluid flow through said second flow path when said valve member is in its fully open position.

25. The two-stage valve of claim 24 wherein said zero vacuum valve comprises an annular-shaped seal formed on said diaphragm that is adapted to seat against said wall of said valve body.

26. The two-stage valve of claim 25 wherein said second flow path includes an annular-shaped opening in said wall of said valve body.

27. The two-stage valve of claim 26 wherein said zero vacuum valve is adapted to block fluid flow between said high flow orifice and said annular-shaped opening in said wall when seated against said wall.

28. The two-stage valve of claim 21 further including calibration means for adjusting the position of said fixed pintle member relative to said valve body.

* * * * *